US005265673A

United States Patent [19]

Hucsko

[11] Patent Number: 5,265,673

[45] Date of Patent: Nov. 30, 1993

[54] COMPACT MANIFOLD FOR A HEAT EXCHANGER WITH MULTIPLE IDENTICAL HEATING TUBES

[75] Inventor: John Hucsko, Cambridge, Canada

[73] Assignee: AOS Holding Company, Wilmington, Del.

[21] Appl. No.: 24,990

[22] Filed: Mar. 2, 1993

[51] Int. Cl.[5] ..... F28D 7/06

[52] U.S. Cl. ..... 165/176; 165/78; 137/561 A; 237/56

[58] Field of Search ..... 165/176, 175, 174, 173; 237/56, 8 R, 59; 137/561 A, 602; 29/890.052

[56] References Cited

U.S. PATENT DOCUMENTS

| | | | |
|---|---|---|---|
| 197,273 | 11/1877 | Hays | 165/176 |
| 583,444 | 6/1897 | Bayley | 165/176 |
| 1,856,963 | 5/1932 | Martin | 165/176 |
| 2,437,462 | 3/1948 | Baird | 165/135 |
| 2,611,584 | 9/1952 | Labus | 165/151 |
| 2,733,899 | 2/1958 | Lehmann | 165/150 |
| 3,080,916 | 3/1963 | Collins | 165/151 |
| 3,156,296 | 11/1964 | Kelp | 165/74 |
| 3,223,155 | 12/1965 | Hubbard | 165/176 |
| 3,232,341 | 2/1966 | Woodworth | 165/111 |
| 3,937,275 | 2/1976 | Boisseau | 237/56 |
| 4,172,496 | 10/1979 | Melnyk | 165/76 |
| 4,396,060 | 8/1983 | Schenk | 165/176 |
| 4,415,024 | 11/1983 | Baker | 165/78 |
| 4,483,392 | 11/1984 | Korsmo et al. | 165/150 |
| 4,520,867 | 6/1985 | Sacca et al. | 165/176 |
| 4,549,605 | 10/1985 | Sacca et al. | 165/150 |
| 4,770,240 | 9/1988 | Dawson et al. | 165/176 |

FOREIGN PATENT DOCUMENTS

| | | | |
|---|---|---|---|
| 1632421 | 3/1970 | Fed. Rep. of Germany | 137/561 A |
| 2940035 | 5/1981 | Fed. Rep. of Germany | 165/176 |
| 155195 | 5/1992 | Japan | 165/176 |
| 107446 | 5/1943 | Sweden | 165/174 |
| 20853 | of 1902 | United Kingdom | 165/176 |

*Primary Examiner*—Martin P. Schwadron
*Assistant Examiner*—L. R. Leo
*Attorney, Agent, or Firm*—David R. Price; James Earl Lowe, Jr.

[57] ABSTRACT

A manifold for a heat exchanger including a plurality of substantially identical heating tubes. The manifold has front and rear walls. The rear wall has therein a plurality of inlet ports, each of which is adapted to be connected to the outlet of one of the heating tubes, the inlet ports being generally equally spaced along the rear wall in the upper half of the manifold. The rear wall also has therein a plurality of outlet ports, each of which is adapted to be connected to the inlet of one of the heating tubes, the outlet ports being generally equally spaced along the rear wall in the lower half of the manifold. The front wall has therein a water inlet opening into both the upper manifold half and the lower manifold half, and a water outlet spaced horizontally from the water inlet and opening into both the upper manifold half and the lower manifold half. The manifold also includes an involuted web which extends between the front and rear walls, which is attached to the front wall above the water inlet and below the water outlet so as to separate the inlet and the outlet, and which is attached to the rear wall along a horizontal line separating the inlet and outlet ports so that water entering through the water inlet communicates only with the outlet ports and water entering through the inlet ports communicates only with the water outlet.

6 Claims, 3 Drawing Sheets

COMPACT MANIFOLD FOR A HEAT EXCHANGER WITH MULTIPLE IDENTICAL HEATING TUBES

BACKGROUND OF THE INVENTION

The invention relates to manifolds for heat exchangers with multiple heating tubes, and more particularly to compact manifolds for heat exchangers with multiple identical heating tubes.

SUMMARY OF THE INVENTION

This invention provides a manifold for a heat exchanger including a plurality of substantially identical heating tubes. The manifold has a longitudinal axis, and a plane which includes the longitudinal axis, and which divides the manifold into a first manifold half and a second manifold half. Preferably, the axis extends horizontally, the plane is horizontal, and the first and second halves are upper and lower halves, respectively. The manifold further includes a first or rear wall comprising a plurality of inlet ports, each of which is adapted to be connected to the outlet of one of the heating tubes, the inlet ports being generally equally spaced along the rear wall the length of the manifold and in the upper manifold half. The rear wall also includes a plurality of outlet ports, each of which is adapted to be connected to the inlet of one of the heating tubes, the outlet ports being generally equally spaced along the rear wall the length of the manifold and in the lower manifold half. The manifold also includes an opposed or front wall opposite the rear wall and including a water inlet opening into both the upper manifold half and the lower manifold half, and a water outlet spaced from the water inlet along the longitudinal axis and opening into both the upper manifold half and the lower manifold half. The manifold also includes an involuted web which extends between the front and rear walls, which is attached to the front wall above the water inlet and below the water outlet so as to separate the inlet and the outlet, and which is attached to the rear wall generally along where the plane intersects the rear wall so that water entering through the water inlet communicates only with the outlet ports and water entering through the inlet ports communicates only with the water outlet.

One of the principal features of the invention is the provision of a compact manifold for a heat exchanger with multiple identical heating tubes.

Another of the principal features of the invention is the provision of such a manifold that equally balances water flow through each of the heating tubes.

Another of the principal features of the invention is the provision of such a manifold where both the manifold water inlet and the manifold water outlet are sufficiently large so as to permit a substantial amount of water flow through all of the heating tubes.

Other features and advantages of the invention will become apparent to those skilled in the art upon review of the following detailed description, claims and drawings.

Figure 1:
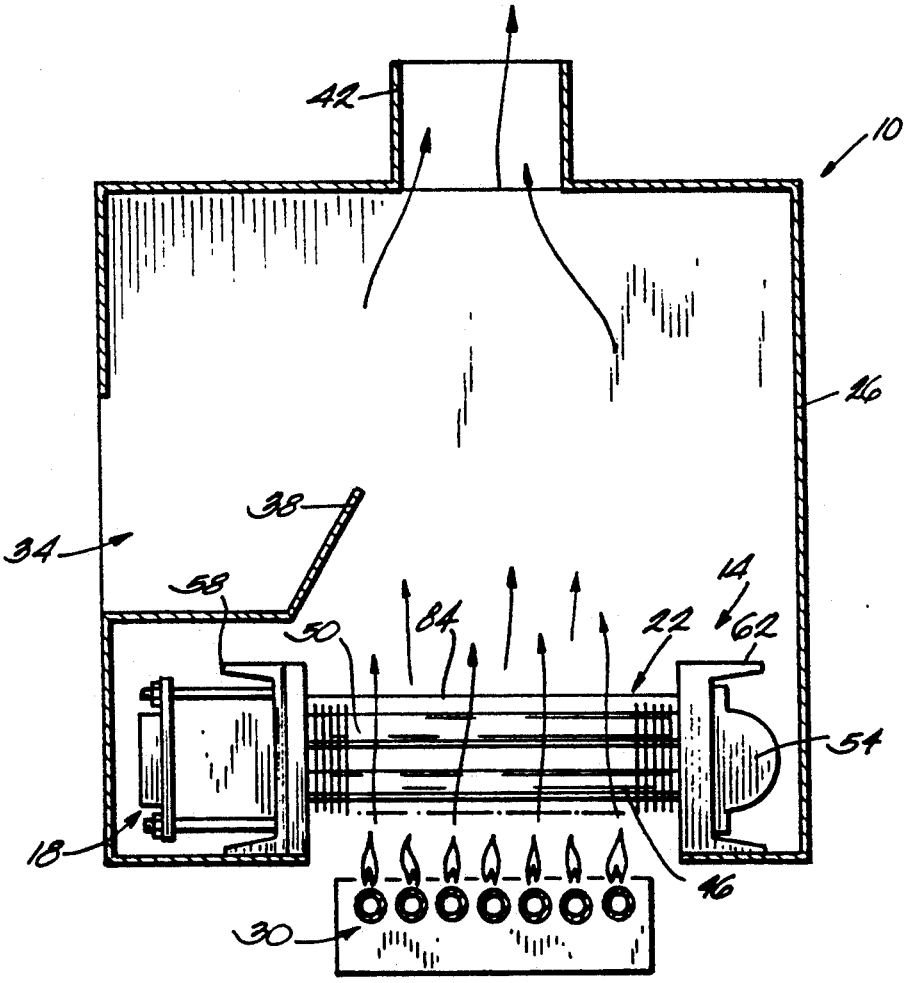
FIG. 1 is a cross-sectional view of a hot water heater including a heat exchanger which embodies various of the features of the invention.
Figure 5:
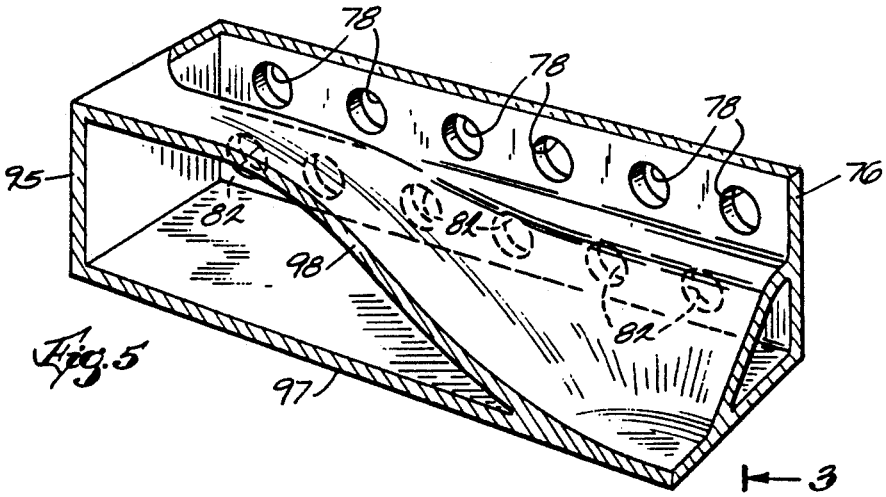
FIG. 5 is a partial perspective view of the manifold illustrating the involuted web.

Before one embodiment of the invention is explained in detail, it is to be understood that the invention is not limited in its application to the details of the construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Illustrated in FIG. 1 is a water heater 10 including a heat exchanger 14 comprising a manifold 18 and a plurality of substantially identical heating tubes 22. In the preferred embodiment, the heating tubes 22 are from three to six feet in length. The water heater 10 includes a combustion housing 26 which encloses the heat exchanger 14, and a plurality of conventional burners such as gas burners 30 mounted below the heat exchanger 14. The combustion housing 26 further includes a dilution air inlet 34 and a dilution air deflector plate 38. A flue outlet 42 communicates with the top of the combustion housing 26.

Figure 3:
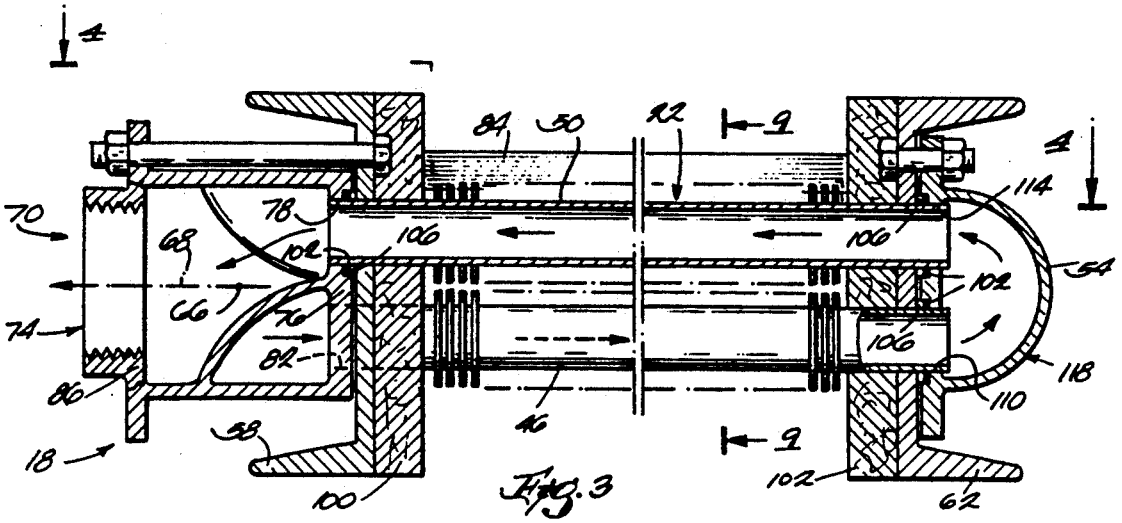
FIG. 3 is a view taken along line 3—3 in FIG. 2, with the manifold broken away to show the inlet.

Each of the heating tubes 22 includes (see FIGS. 1, 3 and 4) a lower finned straight section 46, an upper finned straight section 50, and an elbow section 54 which communicates the lower finned straight section 46 with the upper finned straight section 50. The left end (as shown in FIG. 3) of the upper section 50 defines the outlet of the tube 22, and the left end (as shown in FIG. 3) of the lower section 46 defines the inlet of the tube 22. The heat exchanger 14 further includes a first end plate 58 and a second end plate 62 for mounting the heat exchanger 14 in the combustion housing 26, as hereinafter described.

The manifold 18 has (see FIGS. 2 and 3) a horizontal longitudinal axis 66 and a horizontal plane 68 which includes the longitudinal axis 66 and which divides the manifold 18 into a first or upper manifold half 70 and a second or lower manifold half 74.

Figure 2:
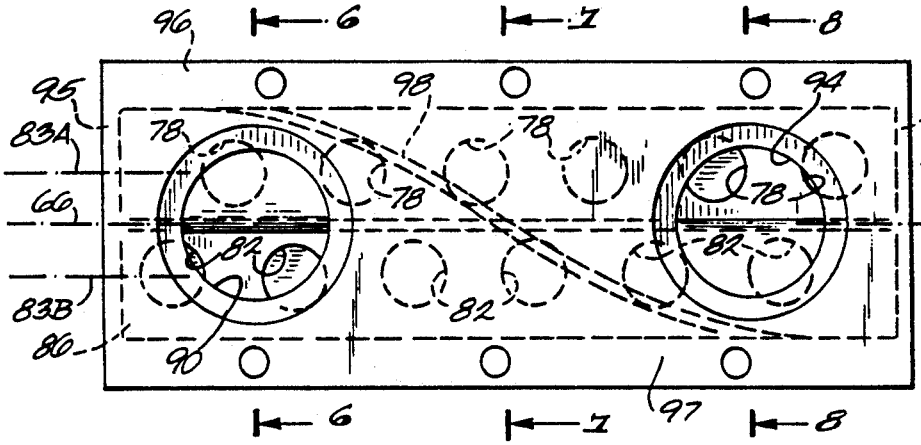
FIG. 2 is a view of the heat exchanger taken along line 2—2 in FIG. 1.
Figure 6:
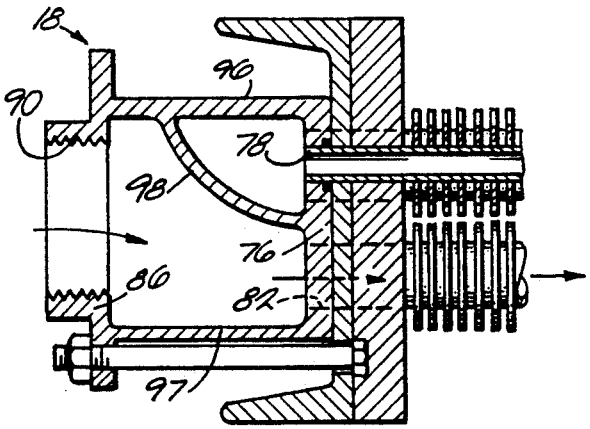
FIG. 6 is a cross-sectional view of the manifold taken along line 6—6 in FIG. 2.
Figure 7:
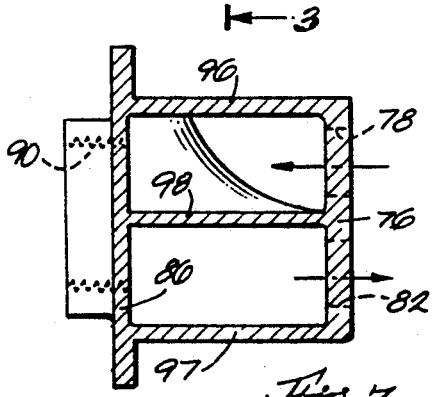
FIG. 7 is a partial cross-sectional view of the manifold taken along line 7—7 in FIG. 2.
Figure 8:
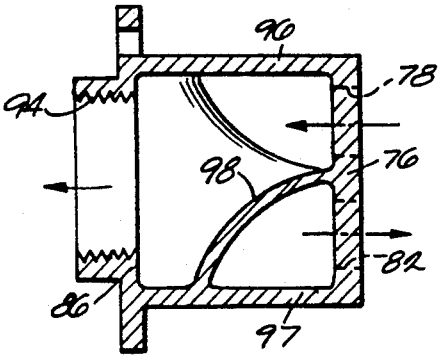
FIG. 8 is a partial cross-sectional view of the manifold taken along line 8—8 in FIG. 2.

The manifold 18 further includes (see FIGS. 5–8) a first or inner or rear wall 76 having therein a plurality of inlet ports 78, each of which is adapted to be connected to the outlet of one of the heating tubes 22, the inlet ports 78 being generally equally spaced along the inner wall 76 the length of the manifold 18 and in the upper manifold half 70. The inner wall 76 also has therein a plurality of outlet ports 82, each of which is adapted to be connected to the inlet of one of the heating tubes 22, the outlet ports 82 being generally equally spaced along the inner wall 76 the length of the manifold 18 and in the lower manifold half 74. As shown in FIG. 2, the inlet ports 78 have centers lying on a first horizontal line 83A, and the outlet ports 82 have centers lying on a second horizontal line 83B beneath the line 83A.

Figure 9:
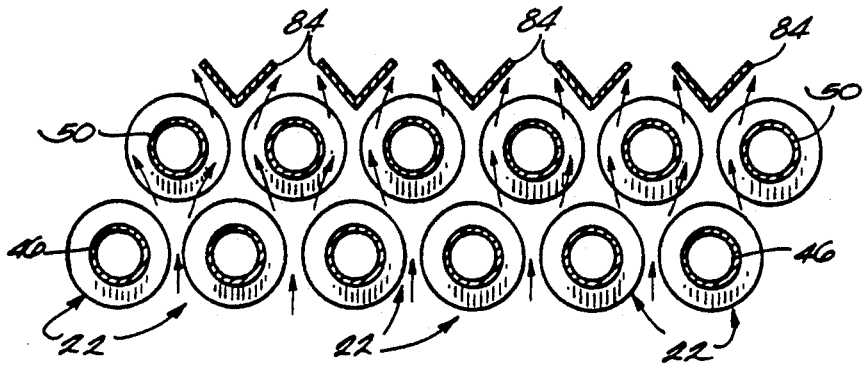
FIG. 9 is a cross-sectional view taken along line 9—9 in FIG. 3.

The inlet ports 78 and outlet ports 82 are tiered in such a way that each heating tube 22 has (as illustrated in FIG. 9) maximum exposure to the heated air passing up through the heating tubes 22. In the preferred embodiment, baffles 84 mounted between the upper straight sections 50 of the heating tubes 22 further insure that heated air passes over the tubes 22. This heating tube layout helps balance stresses within the heat exchanger 14, resulting in lower seal leakage and heating tube failures than in prior art designs.

The manifold 18 also includes (see FIGS. 2 and 5–8) an outer or front wall 86 opposite the inner wall 76. The wall 86 has therein a water inlet 90 opening into both the upper manifold half 70 and the lower manifold half 74, and a water outlet 94 which is spaced from the water inlet 90 along the longitudinal axis 66 and which opens into both the upper manifold half 70 and the lower manifold half 74. Both the water inlet 90 and the water outlet 94 are sufficiently large so as to permit a substantial amount of water flow through all of the heating tubes 22.

The manifold 18 also includes (see FIGS. 2 and 5–8) opposite end walls 95 and top and bottom walls 96 and 97.

The manifold 18 also includes (see FIGS. 2 and 5–8) an involuted web 98 that is preferably integral with and extends between the walls 76 and 86. The web 98 is attached to the outer wall 86 above the water inlet 90, i.e. in the upper manifold half 70, and is attached to the outer wall 86 below the water outlet 94, i.e. in the lower manifold half 74, so that (as shown in FIG. 2) the web 98 separates the inlet 90 and the outlet 94. Also, the web 98 is attached to the inner wall 76 generally along where the plane 68 intersects the inner wall 76, i.e., between the inlet ports 78 and outlet ports 82, so that water entering through the water inlet 90 communicates only with the outlet ports 82 and water entering through the inlet ports 78 communicates only with the water outlet 94. The web 98 equally balances the manifold 18 so that where an outlet port 82 is more restricted, such as seen on the right side of FIG. 5 and in FIG. 8, the adjacent inlet port 78 is more open, and where another inlet port 78 is more restricted, such as seen on the left side of FIG. 5 and in FIG. 6, the adjacent outlet port 82 is more open.

In the preferred embodiment, as illustrated in FIG. 3, the heat exchanger 14 is assembled as follows. Each end of the lower and upper straight sections 46 and 50 of the heating tubes 22 extends through a respective opening in a ceramic insulating blanket 100 (see FIG. 3) and then through a respective opening in the first end plate 58. Likewise, each opposite end of the lower and upper straight sections 46 and 50 of the heating tubes 22 extends through a respective opening in a second ceramic insulating blanket 102 and then through a respective opening in the second end plate 62.

Figure 4:
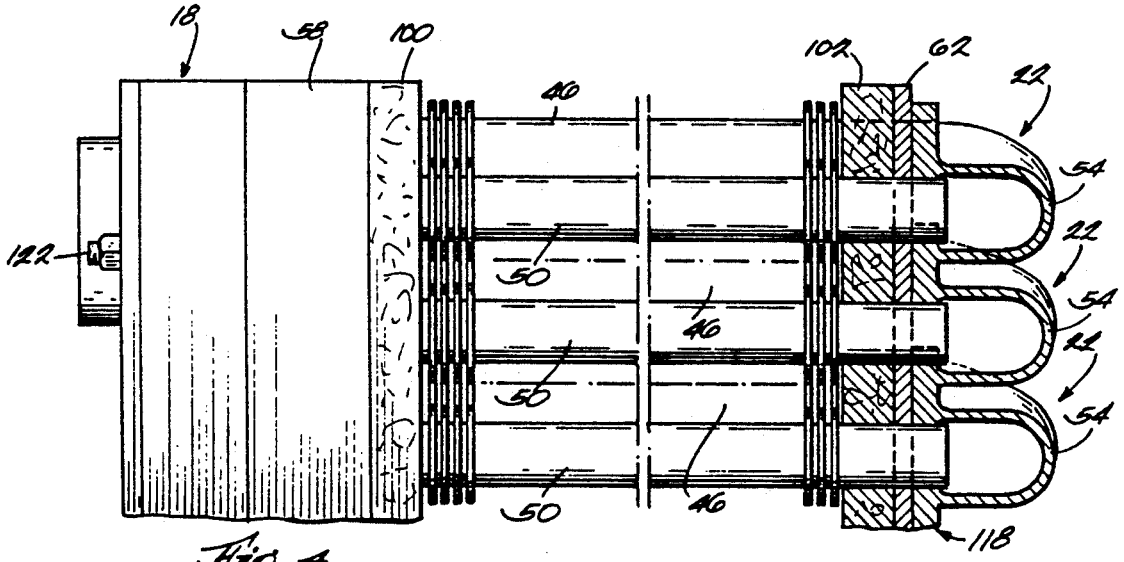
FIG. 4 is a view taken along line 4—4 in FIG. 3.

The left ends of the sections 50 and 46, as illustrated in FIG. 3, are then received within the inlet ports 78 and outlet ports 82, respectively, of the manifold 18. Each right end of a lower straight section 46 is received in a first elbow opening 110, and each right end of an upper straight section 50 is received in a second elbow opening 114. The elbow sections 54 are an integral part of a return member 118 (FIGS. 3 and 4).

In order to provide a water tight seal between each straight section and the ports in the manifold 18 and the openings in the elbow sections 54, an o-ring 102 (see FIG. 3) and a pressure ring 106 are placed around each straight section. The o-ring 102 is located in an O-ring receiving notch and is squeezed between the pressure ring 106 and either the manifold 18 or the return member 118 when the manifold 18 and the elbow sections 54 of the return member 118 are secured to their respective end plates by means of bolts 122.

Other features and advantages of the invention will be set forth in the following claims.

I claim:

1. A manifold for a heat exchanger including a plurality of heating tubes, said manifold having a longitudinal axis and a plane which includes said longitudinal axis and which divides said manifold into a first manifold half and a second manifold half, said manifold comprising a first wall having therein a plurality of inlet ports, each of which is adapted to be connected to the outlet of one of the heating tubes, said inlet ports being generally equally spaced along said first wall in said first manifold half, said first wall also having therein a plurality of outlet ports, each of which is adapted to be connected to the inlet of one of the heating tubes, said outlet ports being generally equally spaced along said first wall in the said second manifold half, a second wall opposed to said first wall, said second wall having therein a water inlet opening into both said first manifold half and said second manifold half, and a water outlet spaced from said water inlet along said axis and opening into both said first manifold half and said second manifold half, and an involuted web which extends between said first and second walls, which is attached to said second wall adjacent said water inlet in said first manifold half and adjacent said water outlet in said second manifold half so as to separate said water inlet and said water outlet, and which is attached to said first wall along a line separating said inlet and outlet ports so that water entering through said water inlet communicates only with said outlet ports and water entering through said inlet ports communicates only with said water outlet.

2. A manifold as set forth in claim 1 wherein said inlet ports have centers lying on a first line, and wherein said outlet ports have centers lying on a second line parallel to said first line.

3. A heat exchanger comprising a plurality of heating tubes having respective inlets and outlets, and a manifold having a horizontal longitudinal axis and a horizontal plane which includes said longitudinal axis and which divides said manifold into an upper manifold half and a lower manifold half, said manifold including a rear wall having therein a plurality of inlet ports, each of which is connected to said outlet of one of said heating tubes, said inlet ports being generally equally spaced along said rear wall in said upper manifold half, said rear wall also having therein a plurality of outlet ports, each of which is connected to said inlet of one of said heating tubes, said outlet ports being generally equally spaced along said rear wall in said lower manifold half, a front wall opposed to said rear wall, said front wall having therein a water inlet which opens into both said upper manifold half and said lower manifold half, and a water outlet which is spaced from said water inlet along said axis and which opens into both said upper manifold half and said lower manifold half, and an involuted web which extends between said front and rear walls, which is attached to said front wall above said water inlet and below said water outlet so as to separate said water inlet and said water outlet, and which is attached to said rear wall along a horizontal line separating said inlet and outlet ports so that water entering through s id water inlet communicates only with said outlet ports and water entering through said inlet ports communicates only with said water outlet.

4. A heat exchanger as set forth in claim 3 wherein said inlet ports have centers lying on a first horizontal line, and wherein said outlet ports have centers lying on a second horizontal line spaced below said first line.

5. A heat exchanger as set forth in claim 3 wherein said heating tubes are substantially identical and each comprises an upper straight section, a lower straight section, and an elbow section connecting said straight sections.

6. A heat exchanger as set forth in claim 3 wherein said web is integral with said front and rear walls.

* * * * *